US006257433B1

(12) United States Patent
Ogg et al.

(10) Patent No.: US 6,257,433 B1
(45) Date of Patent: Jul. 10, 2001

(54) GRIP DOME CONTAINER

(75) Inventors: Richard K. Ogg, Littlestown; Marvin Lee Smith, Dallastown, both of PA (US)

(73) Assignee: Graham Packaging Company, L.P., York, PA (US)

( * ) Notice: Subject to any disclaimer, the term of this patent is extended or adjusted under 35 U.S.C. 154(b) by 0 days.

(21) Appl. No.: 09/463,871

(22) PCT Filed: Jun. 9, 1999

(86) PCT No.: PCT/US99/12883

§ 371 Date: Apr. 27, 2000

§ 102(e) Date: Apr. 27, 2000

(87) PCT Pub. No.: WO99/64300

PCT Pub. Date: Dec. 16, 1999

Related U.S. Application Data

(63) Continuation-in-part of application No. 09/093,655, filed on Jun. 2, 1998, now Pat. No. 6,044,997.

(51) Int. Cl.[7] ..... B65D 90/02
(52) U.S. Cl. ..... 215/381; 215/384
(58) Field of Search ..... 215/381, 382, 215/384; 220/721, 675; D9/564, 451, 530

(56) References Cited

U.S. PATENT DOCUMENTS

| | | | | |
|---|---|---|---|---|
| D. 266,402 | * | 10/1982 | Conrad | D9/404 |
| D. 320,154 | | 9/1991 | Alberghini et al. . | |
| D. 340,190 | | 10/1993 | Skidmore et al. . | |
| D. 344,457 | | 2/1994 | Prevot et al. . | |
| D. 365,277 | | 12/1995 | Hencher . | |
| D. 366,416 | | 1/1996 | Semersky . | |
| D. 366,417 | | 1/1996 | Semersky . | |
| D. 366,831 | | 2/1996 | Semersky et al. . | |
| D. 374,826 | | 10/1996 | Mackinson et al. . | |
| D. 378,274 | | 3/1997 | Beaver . | |
| D. 378,353 | | 3/1997 | Emre et al. . | |
| D. 387,279 | | 12/1997 | Emre et al. . | |
| D. 392,894 | * | 3/1998 | Steih et al. | D9/542 |
| D. 398,538 | | 9/1998 | Fuquen et al. . | |
| D. 398,539 | | 9/1998 | Guislain . | |
| D. 420,919 | | 2/2000 | Ogg . | |
| 2,013,243 | | 9/1935 | Landon . | |
| 3,536,500 | | 10/1970 | Cleereman . | |
| 4,023,679 | | 5/1977 | Hammes . | |
| 4,700,856 | | 10/1987 | Campbell et al. . | |
| 4,813,556 | | 3/1989 | Lawrence . | |
| 5,178,289 | | 1/1993 | Krishnakumar et al. . | |
| 5,224,614 | | 7/1993 | Bono et al. . | |
| 5,238,129 | | 8/1993 | Ota . | |
| 5,392,937 | | 2/1995 | Prevot et al. . | |
| 5,598,941 | | 2/1997 | Semersky et al. . | |
| 5,762,221 | | 6/1998 | Tobias et al. . | |
| 5,803,290 | | 9/1998 | Bongiorno . | |
| 6,044,997 | | 4/2000 | Ogg . | |

* cited by examiner

*Primary Examiner*—Allan N. Shoap
*Assistant Examiner*—Tri M. Mai
(74) *Attorney, Agent, or Firm*—Howson and Howson

(57) ABSTRACT

An ergonomically friendly container (10, 30) having hot-fill capabilities is disclosed. The container (10, 30) has a pre-ovalized dome (14, 34) with grip surfaces (20, 21, 40, 42) that undergo controlled deformation for accommodating a portion of the volumetric shrinkage due to hot-filling, capping, and cooling. Preferably, anti-racking ribs (**32*a*, 32*b*) extend laterally between the grip surfaces (20, 21, 40, 42) to prevent unwanted racking or twisting of the dome (14, 34**) during vacuum absorption.

16 Claims, 5 Drawing Sheets

GRIP DOME CONTAINER

CROSS-REFERENCE TO RELATED APPLICATIONS

This is a 371 of PCT/US99/12883, which is a C-I-P and claims the benefit of the priority of U.S. patent application Ser. No. 09/093,655, filed 12 Jun. 1998 now U.S. Pat. No. 6,044,997.

FIELD OF THE INVENTION

The present invention relates to grippable blow-molded plastic containers, and more particularly, the present invention relates to hot-fillable blow-molded plastic containers having grip features that facilitate lifting and pouring.

BACKGROUND OF THE INVENTION

The conventional hot-fillable blow-molded PET container is generally characterized by a body portion having a series of vertically elongate vacuum flex panels disposed in spaced relation about its periphery for accommodating volumetric shrinkage in the container due to the vacuum created after the container has been hot-filled with liquid, capped and cooled to ambient temperature. The upper portion, or dome, of the container has been generally characterized by a circular cross-section having a waist. Some people use the waist to grip the container for pouring with one hand, but this is not satisfactory because the waist is too large to be gripped readily. A stepped dome is easier to grip, but does not facilitate pouring from the container because it is too far from the filled container center of gravity.

At present, it has been necessary to make the vacuum flex panels relatively long in order to accommodate the amount of vacuum induced shrinkage required to provide a commercially satisfactory container. Examples of such containers are disclosed in the following U.S. patents owned by the assignee of the present application: D366,416; D366,417; D366,831.

Efforts have been made to incorporate grips in hot-fillable containers to afford both ease of pouring and to accommodate the vacuum induced shrinkage of the container. An example of such a container manufactured by the assignee of the present application is disclosed in the following U.S. Pat. Nos. D344,457; 5,392,937; and 5,598,941.

The aforementioned containers have certain advantages and certain disadvantages. The conventional vacuum panel has the advantage of enabling relatively large size containers with large labelable areas to be produced; however, it has disadvantage of making such containers difficult to handle. Grip panel containers, on the other hand, have the advantage of providing relatively easy pourability for certain sizes; however, grip panels are difficult to provide in large size containers, and labelable areas are reduced. It is apparent, therefore, that there is a need for a blow-molded plastic container that provides both the ready gripability and pourability afforded by grip-panel containers while providing large labelable areas and avoiding the limitations associated with conventional vacuum-panel containers.

OBJECTS OF THE INVENTION

With the foregoing in mind, a primary object of the present invention is to provide a novel grippable container that provides facile gripping and pouring of its contents.

Another object of the present invention is to provide an improved hot-fillable blow-molded container which utilizes conventional vacuum panels in combination with a specially configured grip dome that cooperates with the vacuum panels to accommodate the requisite vacuum induced shrinkage of the container due to hotfilling, capping and cooling.

Another object of the present invention is to provide a container having grips formed in its dome to facilitate gripping and pouring of contents from the container while utilizing shorter conventional vacuum panels to thereby provide the container with an ergonomically-improved lifting and pouring balance.

A still further object of the present invention is to provide a plastic blow-molded container having a reinforced grip dome which resists distortion from forces caused by hot-fill processing.

SUMMARY OF THE INVENTION

More specifically, the present invention provides a blow-molded grippable container having a body portion with a series of vacuum panels and a dome portion which incorporates grip panels to facilitate gripping and pouring of contents from the container. In the illustrated embodiment, the dome portion has a non-circular transverse cross-section with opposed elongate sides in which are provided an opposed pair of grip surfaces connected at their opposite ends by a recess extending around opposed peripheral portions of the dome. The grip surfaces are adapted to be engaged between a finger and thumb of the user while the user's hand portion is engaged in the recess. The dome is configured to enable the opposed grip surfaces to flex toward one another to accommodate a predetermined amount of volumetric shrinkage due to hot-filling, capping and cooling. The vacuum flex panels provided in the body portion below the dome accommodate another predetermined amount of volumetric shrinkage.

According to another aspect of the present invention, the peripheral recess of the dome includes a peripheral "anti-racking link", or rib, to prevent unwanted distortion of the dome. The rib permits a controlled amount of dome flexure so that the dome can accommodate a predetermined amount of volumetric shrinkage, but resists so-called "racking", or twisting, of the dome which would distort the appearance of the dome.

BRIEF DESCRIPTION OF THE DRAWINGS

The foregoing and other objects, features and advantages of the present invention should become apparent from the following description when taken in conjunction with the accompanied drawings, in which.

DESCRIPTION OF THE PREFERRED EMBODIMENT

Figure 1:
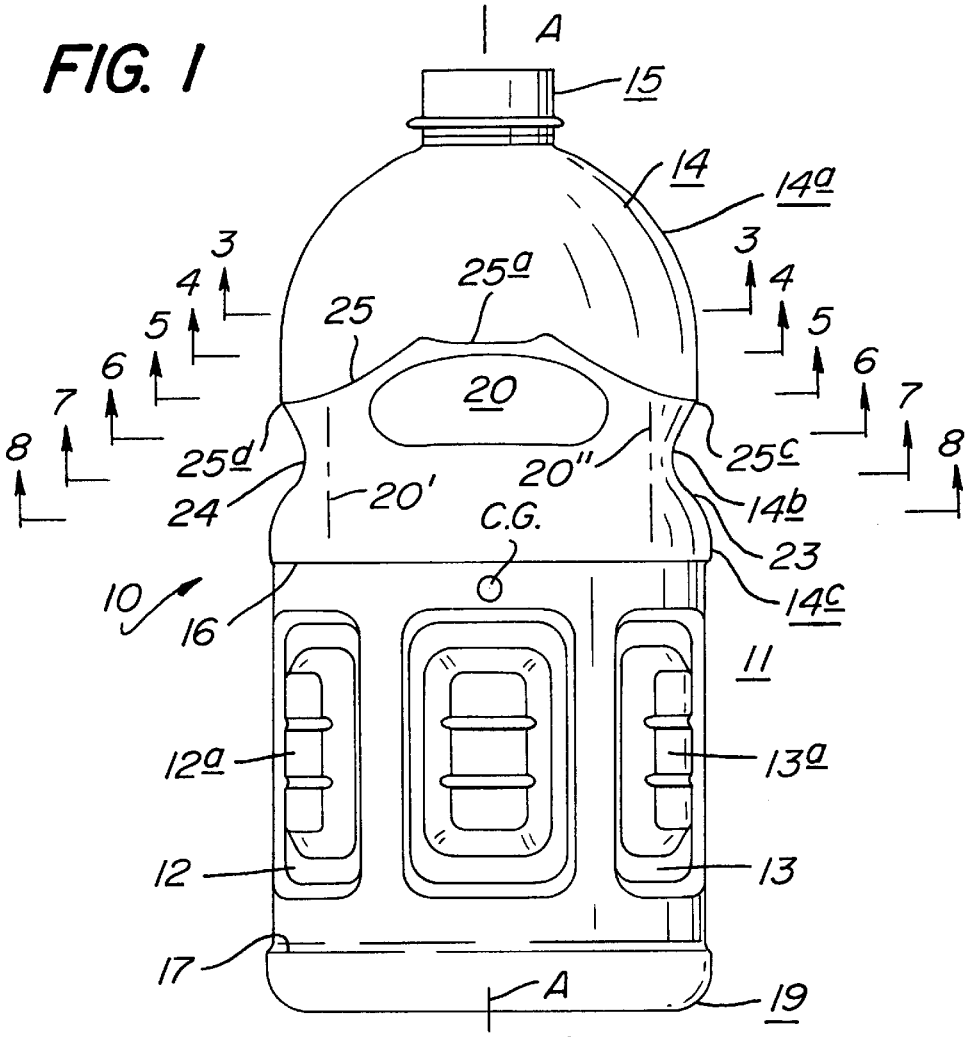
FIG. 1 is a side elevational view of a grippable container embodying the present invention.

Referring now to the drawings, FIG. 1 illustrates a grippable container 10 which is particularly suited for hot fill applications. As best seen therein, the container 10 has a body portion 11, which may be of tubular cross section, such as cylindrical or rectangular, having a plurality of circumferentially spaced vacuum panels, such as the panels 12 and 13. The body portion 11 of the container 10 has an upper label bumper 16 and a lower label bumper 17 both of which extend continuously about the periphery of the body portion 11. The vacuum panels 12 and 13 are located between the label bumpers 16 and 17 for accommodating vacuum induced shrinkage resulting from liquid contraction due to the hot fill process. Thus, the term vacuum induced volumetric shrinkage as used herein refers to such shrinkage, and not to inherent thermally-induced volumetric shrinkage. The vacuum panels 12 and 13 also include customary label support regions 12*a* and 13*a* for supporting a label (not shown) in the region between the upper and lower label bumpers 16 and 17 as well known in the art. A suitable base 19 is provided below the lower label bumper 17. The base 19 is of conventional construction having appropriate reinforcing ribs, such as radial ribs, to provide the desired stiffness and anti-everting capabilities preferred for a hot fill container, as well known in the art.

The container 10 has a dome portion 14 superposed on the body portion 11.

The dome portion 14 has a conventional flanged finish 15 with threads (not shown) adapted to receive a cap. The dome portion 14 has an upper section 14*a* an intermediate section 14*b*, and a lower section 14*c* superadjacent the upper label bumper 16. The dome 14 lies within a cylindrical plane extending upwardly tangent to the upper label bumper 16.

Figure 3:
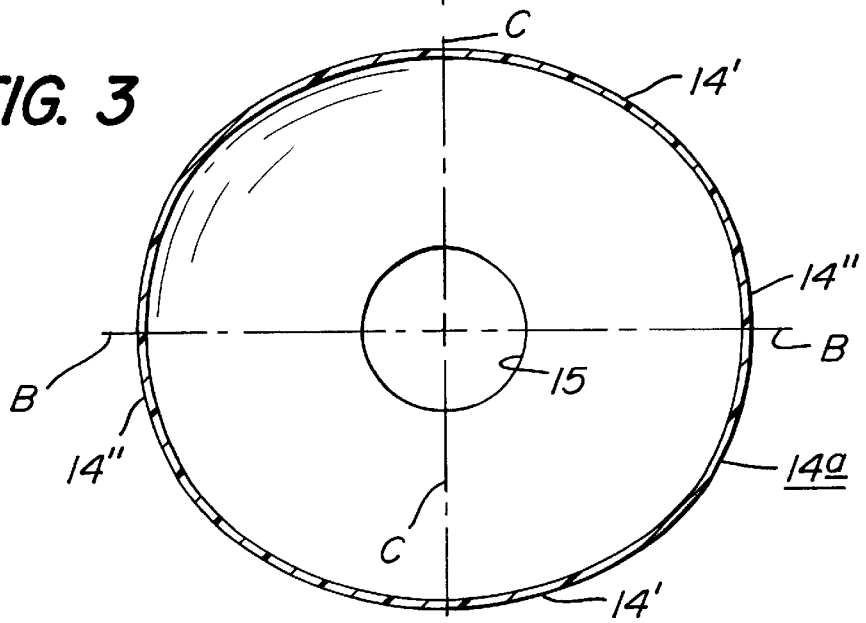
FIG. 3 is a transverse sectional view taken along line 3—3 of FIG. 1.

As best seen in FIG. 3, the upper dome section 14*a* has a non-circular transverse cross-section that diverges outwardly and downwardly from the finish 15. Preferably, both the upper and intermediate dome sections 14*a* and 14*b*, respectively, have elliptical transverse cross-sections in a plane perpendicular to a longitudinal axis A—A extending vertically through the center of the container 10. The lower dome section 14*c* also has an elliptical cross section that flares circularly outwardly and downwardly to merge with the circular upper label bumper 16.

As also seen in FIG. 3, the major, or long, axis B—B of the elliptical sections of the dome 14 extends front to rear of the container 10, and the minor, or short, axis C—C of the dome 14 extends side to side of the container 10. The dome 14 has an opposed pair of inwardly concave, curved elongate sidewalls 14', 14' connected at their ends to inwardly concave curved arcuate endwalls 14", 14".

Figure 2:
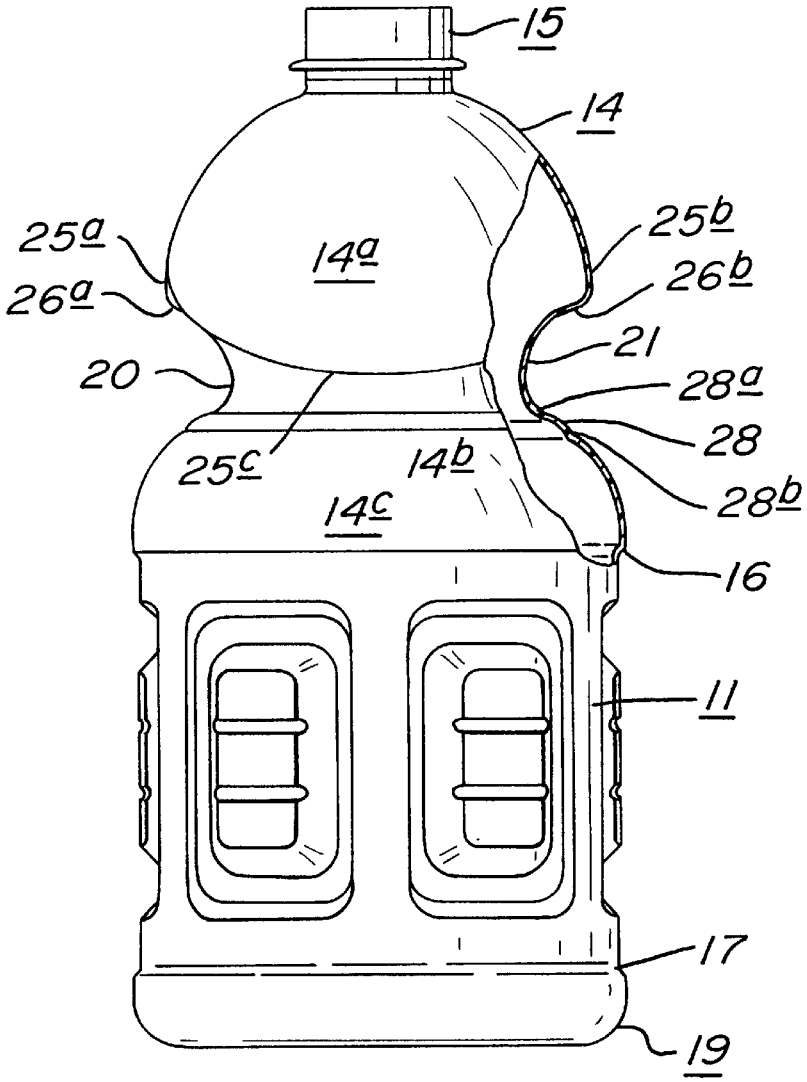
FIG. 2 is a front elevational view of the container illustrated in FIG. 1 but with portions broken away.
Figure 4:
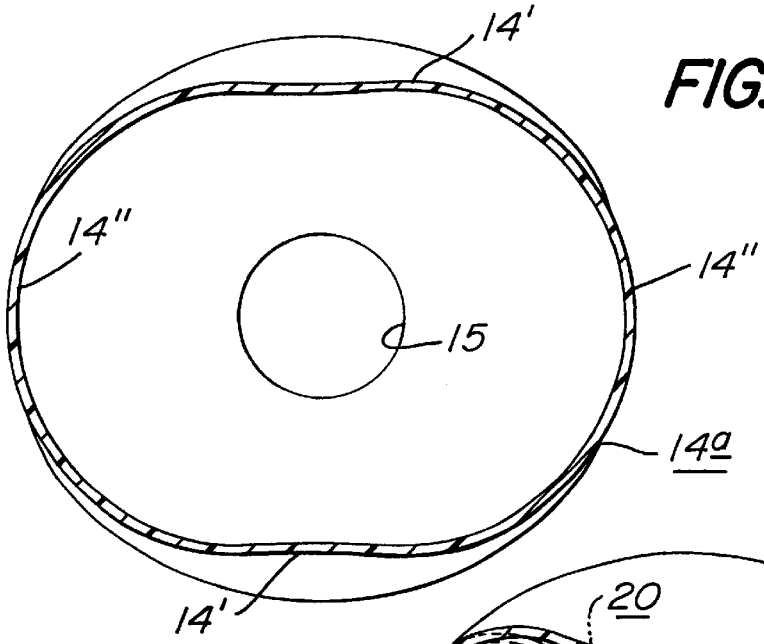
FIG. 4 is a transverse sectional view taken along line 4—4 of FIG. 1.

Referring to FIG. 2, the upper section 14*a* of the dome 14 has an inwardly concave vertical cross-section providing a chamber having a generally bulbous concave configuration. The upper dome section 14*a* terminates in a continuous curved undulating brow rib 25 having an opposed pair of flattened apogees 25*a* and 25*b* located in the dome sidewalls, and having an opposed pair of perigees 25*c* and 25*d* located in the dome endwalls. Anti-slip ledges, or shoulders 26*a* and 26*b* are provided above each apogee, such as apogee 25*a*, for purposes to be described.

The intermediate dome section 14*b* has a pair of opposed transversely elongate grip surfaces 20 and 21 which are inset deeply into the dome 14 below the brow rib apogees 25*a* and 25*b*, respectively, and are preferably outwardly concave to afford engagement between a user's thumb and finger, such as the index finger. The grip surfaces 20 and 21 extend equidistantly on opposite sides of the container longitudinal axis A—A and are located above, but adjacent to, the upper label bumper 16. Recesses 23 and 24, which are less deeply inset into the dome 14 than the grip surfaces 20 and 21, interconnect the grip surfaces 20 and 21 at their opposite ends. The grip surfaces 20 and 21 cooperate with the peripheral recesses 23 and 24 to enable the user to place his or her index finger and thumb on the grip surfaces 20 and 21 and the connecting hand region in either the recess 23, or the recess 24, to lift and pour from either the front or back of the container 10. The brow rib 25 above the rip surfaces 20 and 21 and recesses 23 and 24 cooperates with the anti-slip ledges 26*a*, 26*b* to provide a surface region against which the upper sides of the user's finger, thumb, and hand may be placed, while the user's palm engages the generally circular surface of the lower dome section 14*c* when manipulating the container 10.

In the illustrated embodiment (drawn in FIGS. 1 and 2 to approximately half full scale) the container 10 has a filled nominal capacity of 96 ozs. The capacity of the body portion 11 up to the upper label bumper 16, is about 56 ozs. The capacity of the dome between the upper label bumper 16 and the top of the finish 15 is about 40 ozs. As a result, the dome portion provides approximately 41 percent of the total nominal volumetric capacity of the container 10. By way of comparison with a stock 96 oz circular bell cross-section conventional vacuum panel container of Applicant's manufacture, the bell volume constitutes about 30% of the total container filled volume.

The filled center of gravity of the container (C.G.) is located about 125 mm of the overall height of the container 10 which is 292 mm measured from a base support datum, such as a flat surface on which the container is placed. Preferably, the filled center of gravity is located in a range of about 40% to about 45% of the overall container height, or length, and the grip surfaces 20, 21 are located upwardly adjacent the filled center of gravity within about 55% to about 65%, and more preferably about 60% of the overall container height. Desirably, the grip surfaces 20 and 21 are separated by a distance in a range of about 75 to about 90 mm across the minor axis C—C of the elliptical cross-section illustrated. The grip surfaces have an overall length of about 70 mm, and the shortest peripheral distance from the center of one grip surface 20 to the center of the opposite grip surface 21 is about 175 mm. The aforedescribed dimensional and surface configurations cooperate to provide a container which can be lifted and its contents poured in a facile manner.

The container 10 is particularly suited for hot-fill applications. Under conditions of hot-filling with liquid at a temperature approaching 200° F., capping, and cooling to ambient temperatures of about 72° F., the body portion vacuum panels, such the panels 12 and 13, flex inwardly as well known in the art to accommodate volumetric shrinkage. However, unlike conventional hot fill containers, in the container 10 of the present invention, the vacuum panels do not accommodate all of the container's volumetric shrinkage. Rather, in the container of the present invention, the dome 14 accommodates approximately 5% of the total volumetric shrinkage of the container 10 due to hot fill, capping, and cooling. The balance is accommodated by the conventional vacuum panels, such as panels 12 and 13.

Figure 5:
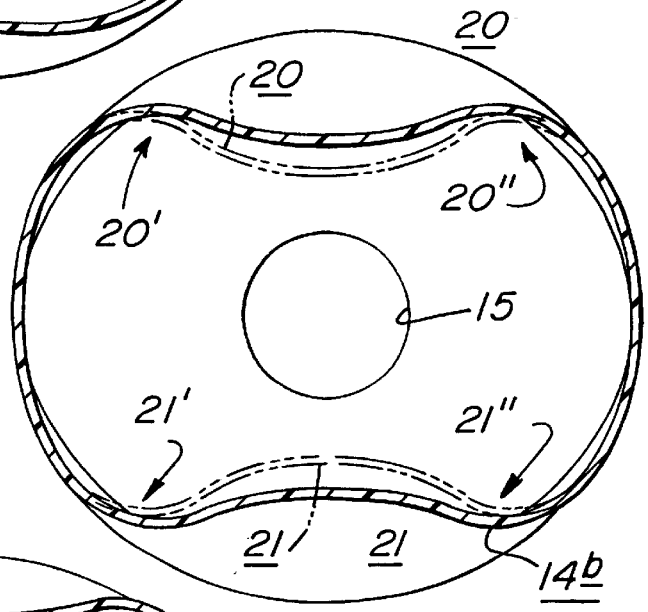
FIG. 5 is a transverse sectional view taken along line 5—5 of FIG. 1.
Figure 6:
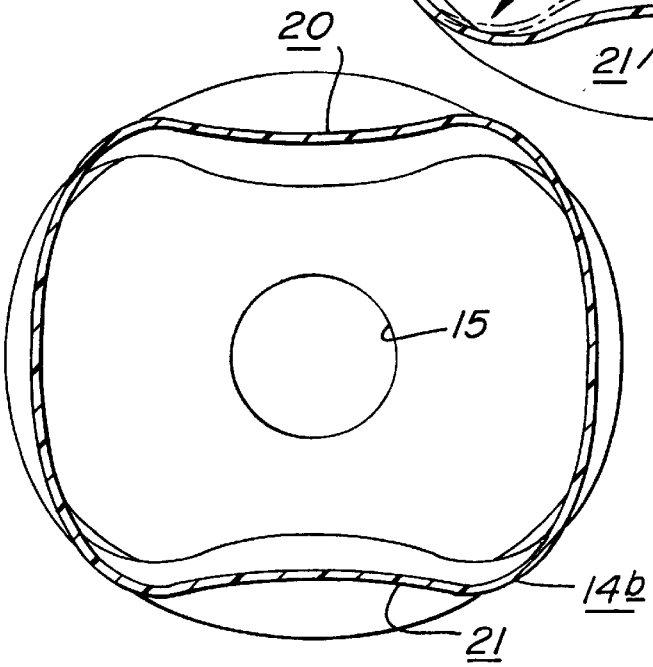
FIG. 6 is a transverse sectional view taken along line 6—6 of FIG. 1.
Figure 7:
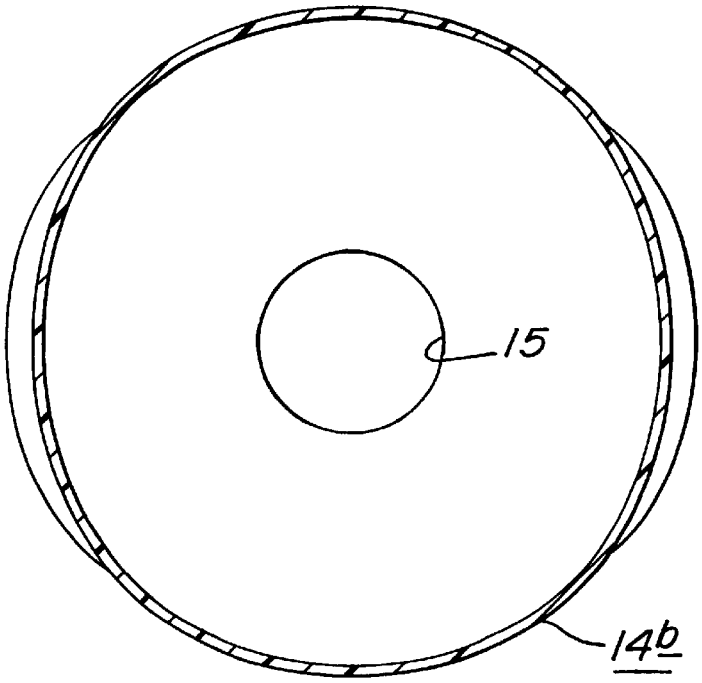
FIG. 7 is a transverse sectional view taken along line 7—7 of FIG. 1.
Figure 8:
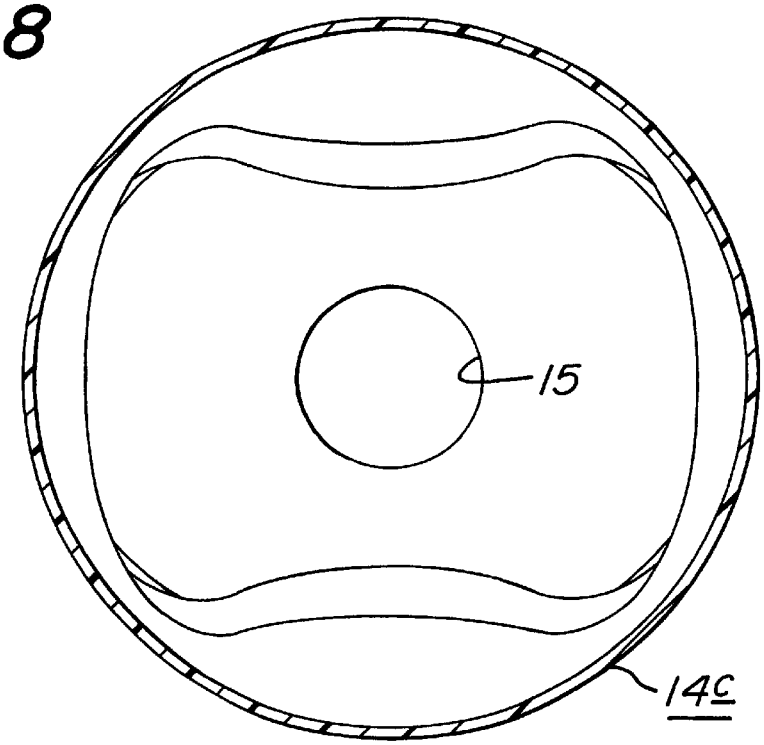
FIG. 8 is a transverse sectional view taken along line 8—8 of FIG. 1.

In the present invention, the grip surfaces 20 and 21 are mounted to flex inwardly toward one another by means of flexible webs to accommodate volumetric shrinkage in the dome 14. Such flexural movement may be seen in FIG. 5 which schematically illustrates in phantom lines the inward deflection of the grip surfaces 20 and 21 in their inwardly-flexed positions. The geometry of the dome tends to afford flexure primarily from side to side to provide the requisite grip surface movement. Flexure occurs about two pairs of vertical hinge lines located generally in the regions 20', 20" and 21', 21" shown in FIGS. 1 and 5. Shrinkage is also facilitated to some extent by the inwardly concave peripheral hinge web region 28 (FIG. 2) located adjacent the juncture of the intermediate dome section 14*b* and lower dome section 14*c* in conjunction with the overlying brow rib 25. As seen in FIG. 2, the hinge web 28 is inwardly convex relative to upper and lower spaced lines of inflection 28*a* and 28*b*, respectively, which extend peripherally around the dome 14.

Figure 9:
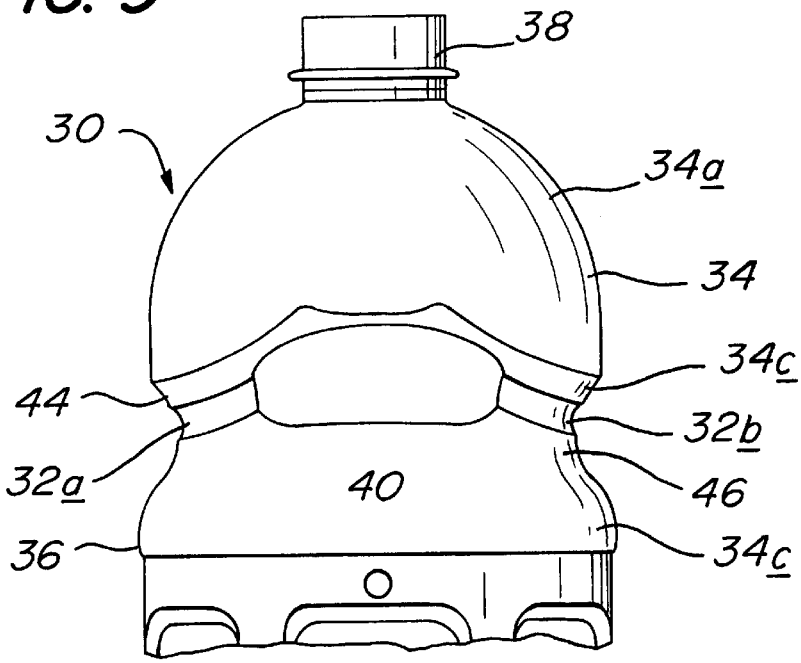
FIG. 9 is a side elevational view of a top portion of a second embodiment of a grippable container according to the present invention.
Figure 10:
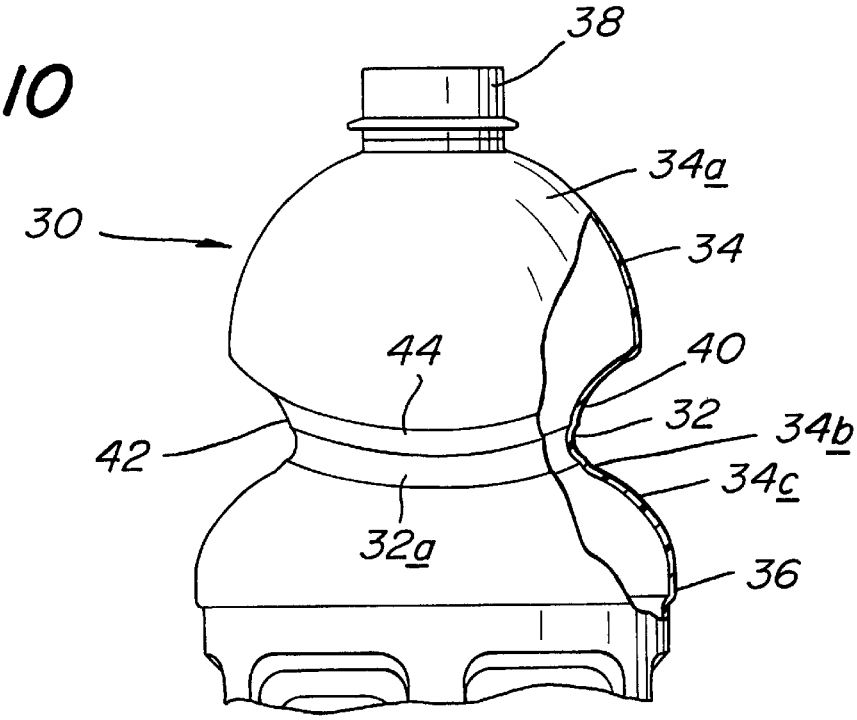
FIG. 10 is a front elevational view of the top portion of the container illustrated in FIG. 9 but with portions broken away.

Preferably, the container is provided with means to reinforce the dome to prevent unwanted distortion while permitting the required amount of vacuum absorption. The container 30, illustrated in FIGS. 9 and 10, is identical to the container 10 except for the peripheral reinforcement ribs 32*a* and 32*b*. To this end, the container 30 has a finish 38 and a dome portion 34 with an upper section 34*a*, an intermediate section 34*b*, and a lower section 34*c* superadjacent an upper label bumper 36. The intermediate dome section 34*b* has a pair of opposed grip surfaces 40 and 42 which are inset into the dome 34 and which afford engagement of the dome 34 between a user's thumb and finger. Peripheral recesses 44 and 46 are inset into the intermediate dome section 34*b* and interconnect the grip surfaces 40 and 42 at their opposite ends.

The peripheral reinforcement rib, or so-called "anti-racking link", 32*a* extends in the peripheral recess 44 laterally between the grip surfaces 40 and 42, and the peripheral reinforcement rib, or so-called "anti-racking link", 32*b* extends in the peripheral recess 46 laterally between the grip surfaces 40 and 42 . Each rib, 32*a* and 32*b* is transversely elongate and extends to the opposite ends of the grip surfaces 40 and 42. As illustrated, the ribs 32*a* and 32*b* are outwardly concave, or C-shaped, in vertical cross-section and are located on the innermost portions of peripheral recess 44 and 46. The opposed ribs 32*a* and 32*b* cooperate to reinforce the dome 34 and prevent unwanted "racking", or twisting, of the dome 34 as might occur during certain vacuum absorption conditions of the dome 34. Thus, the ribs 32*a* and 32*b* allow the grippable dome 34 to accommodate a pre-determined amount of vacuum in a controlled manner, while preventing the bell-shaped dome 34 from becoming distorted. If conditions conducive to dome racking are not encountered, the use of the ribs, or anti-racking links, 32*a* and 32*b* can be eliminated.

As a result of dome vacuum absorption, the vacuum panels in the body portion 11 are shorter in vertical height than conventional flex panels, since they do not provide the sole means for vacuum absorption. By reducing the height of the vacuum panels, and providing a predetermined measure of vacuum absorption in the domes 14 and 34, the grip surfaces 20, 21, 40 and 42 are able to be located at a point slightly higher than the filled center of gravity of the container 10 or 30, making the containers 10 and 30 easy to grasp, lift, and pour, as contrasted with conventional cylindrical vacuum flex panel containers which simply have circular dome cross-sectional configurations with concomitant ergonomic limitations.

The dome configurations 14 and 34 not only provide ergonomically-desirable lift and pour capabilities, but also provide the containers 10 and 30 with excellent top loading capabilities. The shortened height of the flex panels reduces the height of the label, but still provides a label area larger in size than on a comparable sidewall grip container. The larger dome enables customer designs and logotypes to be molded prominently in the dome.

Preferably, the containers 10 and 30 are blow molded of PET plastic in a heat-set mold utilizing commercially available blow-molding equipment.

If the hot fill capabilities are not required, the body portion flex panels may be eliminated, and other plastic materials may be used. The containers 10 and 30 would still retain their ergonomic lift and pour capabilities.

While a preferred embodiment of the present invention has been described in detail, various modifications, alterations and changes may be made without departing from the spirit and scope of the invention as defined in the appended claims.

What is claimed is:

1. A grippable container (10, 30) comprising:

a cylindrical body portion (11) having a periphery, a dome portion (14, 34) with a finish (15) above said body portion (11), said dome portion having an intermediate peripheral section inset from said body portion periphery, said dome portion (14, 34) having a non-circular transverse cross-section and an outwardly and downwardly divergent longitudinal cross-section below said finish (15), said transverse cross-section having an opposed pair of grip surfaces (20, 21, 40, 42) affording engagement between a user's thumb and finger, said grip surfaces being inset in said intermediate peripheral section, and a pair of opposed inset peripheral anti-racking ribs extend on said intermediate peripheral section laterally of said grip surfaces, whereby the grip surfaces (20, 21, 40, 42) afford facile lifting and pouring of contents from the container.

2. A container (10, 30) according to claim 1 wherein said dome portion (14, 34) has a volumetric capacity in a range of about 35 to about 45% of the total volumetric capacity of the container (10, 30).

3. A container (10, 30) according to claim 1 wherein said container (10, 30) has a filled center of gravity located in a range of about 40 to about 45% of the overall height of the container (10, 30), and said grip surfaces (20, 21, 40, 42) are located upwardly adjacent said filled center of gravity within about 60% of said overall height.

4. A container (10, 30) according to claim 1 wherein said transverse crosssection is elliptical and has opposed inwardly concave elongate side portions 14', and said grip surfaces (20, 21, 40, 42) are located in said elongate side portions (14').

5. A container (10, 30) according to claim 1 wherein said body portion (11) has a circular upper label bumper (16, 36), and said grip surfaces (20, 21, 40, 42) are located adjacent said bumper (16, 36) and are inset therefrom.

6. A container (10, 30) according to claim 1 wherein said inwardly divergent longitudinal cross section is concave inwardly to provide said dome (14, 34) with a bulbous configuration.

7. A container (10, 30) according to claim 1 including flexible webs (28) in said dome portion (14, 34) mounting said grip surfaces (20, 21, 40, 42) for movement inwardly toward one another in response to vacuum-induced shrinkage of the container (10, 30).

8. A container (10, 30) according to claim 1 wherein said grip surfaces (20, 21, 40, 42) are inset further into said dome (14, 34) than are said opposed peripheral recesses (23, 24, 44, 46).

9. A container (10, 30) according to claim 8 wherein said grip surfaces (20, 21, 40, 42) are transversely elongate and are outwardly concave.

10. A container (10, 30) according to claim 9 including an anti-slip ledge (26*a*, 26*b*) located above at least a portion of each grip surface (20, 21, 40, 42).

11. A container (10, 30) according to claim 9 wherein said dome (14, 34) has a continuous curved peripheral brow (25) that overlies said grip surfaces (20, 21, 40, 42) and said inset recesses (23, 24, 44, 46).

12. A container (10, 30) according to claim 9 wherein said grip surfaces (20, 21, 40, 42) are spaced apart a distance in a range of about 75 to about 90 mm at the minor axis of said elliptical cross-section.

13. A readily grippable, hot-fillable, container (10, 30) having facile handling characteristics, comprising:

a cylindrical body portion (11) having a plurality of peripherally spaced vacuum flex panels (12, 13), said body portion (11) having an upper label bumper (16, 36) with said vacuum flex panels (12, 13) located therebelow, a dome portion (14, 34) with a finish (15) overlying said body portion (11), said dome portion (14, 34) having an elliptical transverse cross-section and an inwardly concave longitudinal cross section, said elliptical transverse cross section having side portions (14') each with a grip surface (20, 21, 40, 42) formed therein to afford engagement by a user's thumb and finger when the user's hand is engaged transversely with the dome portion (14, 34), said grip surfaces being outwardly concave and inset into said dome, said dome portion (14, 34) above said upper label bumper (16, 36) being flexible to enable at least said grip surfaces (20, 21, 40, 42) to move inwardly toward one another for accommodating vacuum-induced shrinkage resulting from hot filling, capping and cooling of the container (10, 30), said grip surfaces being interconnected at their opposite ends by a recess in said dome sized to receive a user's hand region between the index finger and thumb, said recess having a peripheral anti-racking rib which extends between said grip surfaces, whereby at least some of the vacuum-induced volumetric shrinkage of the container is accommodated by the dome while the grip surfaces afford facile lifting and pouring of the container contents by the user.

14. A container (10, 30) according to claim 13 wherein said body portion (11) commodates less than about 95% of the total vacuum induced volumetric shrinkage of the container (10, 30).

15. A container (10, 30) according to claim 13 wherein said dome portion (14, 34) is immediately superadjacent said upper label bumper (16, 36) and accommodates at least about 5% of the total vacuum induced volumetric shrinkage of the container (10, 30).

16. A container (10, 30) according to claim 13 wherein said container (10, 30) has a filled center of gravity at a predetermined location, and said grip surfaces (20, 21, 40, 42) are located above and adjacent to said filled center of gravity location.

* * * * *